US007178350B2

(12) United States Patent
Shah

(10) Patent No.: US 7,178,350 B2
(45) Date of Patent: Feb. 20, 2007

(54) DETERMINATION OF MAXIMUM ALLOWABLE HUMIDITY IN INDOOR SPACE TO AVOID CONDENSATION INSIDE BUILDING ENVELOPE

(75) Inventor: Rajendra K. Shah, Indianapolis, IN (US)

(73) Assignee: Carrier Corporation, Farmington, CT (US)

( * ) Notice: Subject to any disclaimer, the term of this patent is extended or adjusted under 35 U.S.C. 154(b) by 131 days.

(21) Appl. No.: 11/016,373

(22) Filed: Dec. 17, 2004

(65) Prior Publication Data

US 2005/0155362 A1 Jul. 21, 2005

Related U.S. Application Data

(60) Provisional application No. 60/537,527, filed on Jan. 20, 2004.

(51) Int. Cl.
*F25B 49/00* (2006.01)
*F25D 17/04* (2006.01)
*F24F 11/00* (2006.01)

(52) U.S. Cl. ..... 62/176.6; 236/44 C

(58) Field of Classification Search ..... 62/176.1, 62/176.6, 161, 163; 236/44 A, 44 C
See application file for complete search history.

(56) References Cited

U.S. PATENT DOCUMENTS

| | | | | |
|---|---|---|---|---|
| 3,951,625 | A * | 4/1976 | Follette | 96/251 |
| 2005/0155363 | A1* | 7/2005 | Shah | 62/176.6 |
| 2006/0100744 | A1* | 5/2006 | Sharma et al. | 700/276 |

* cited by examiner

*Primary Examiner*—Marc Norman
(74) *Attorney, Agent, or Firm*—Carlson, Gaskey & Olds

(57) ABSTRACT

Known psychometric characteristics of air are employed to achieve accurate indoor relative humidity control to prevent condensation inside a building envelope without complex mathematical computational requirements. An HVAC system control includes a simple control algorithm employed to calculate an effective delta (ΔT) based upon a single adjustment factor (A*) and environmental inputs. The effective delta (ΔT) is then used to determine a maximum allowable indoor relative humidity. The system control is then operable to selectively activate/deactivate a device to adjust an actual indoor relative humidity to a value less than the maximum allowable indoor relative humidity to prevent condensation inside the building envelope.

20 Claims, 3 Drawing Sheets

| HUM LEVEL | 1 | 2 | 3 | 4 | 5 | 6 | 7 | 8 | 9 |
|---|---|---|---|---|---|---|---|---|---|
| ADJ FACTOR A | 0.90 | 0.80 | 0.70 | 0.60 | 0.50 | 0.45 | 0.40 | 0.35 | 0.30 |

ALLOWABLE HUMIDITY
vs DELTA T

ALLOWABLE HUMIDITY

| DELTA T | RH % |
|---|---|
| 75 | 4% |
| 74 | 4% |
| 73 | 4% |
| 72 | 5% |
| 71 | 5% |
| 70 | 5% |
| 69 | 6% |
| 68 | 6% |
| 67 | 6% |
| 66 | 6% |
| 65 | 7% |
| 64 | 7% |
| 63 | 7% |
| 62 | 8% |
| 61 | 8% |
| 60 | 9% |
| 59 | 9% |
| 58 | 10% |
| 57 | 10% |
| 56 | 11% |
| 55 | 11% |
| 54 | 12% |
| 53 | 12% |
| 52 | 13% |
| 51 | 13% |
| 50 | 14% |
| 49 | 15% |
| 48 | 16% |
| 47 | 16% |
| 46 | 17% |
| 45 | 18% |
| 44 | 19% |
| 43 | 20% |
| 42 | 21% |
| 41 | 22% |
| 40 | 22% |
| 39 | 23% |
| 38 | 24% |
| 37 | 25% |
| 36 | 26% |
| 35 | 27% |
| 34 | 29% |
| 33 | 30% |
| 32 | 31% |
| 31 | 32% |
| 30 | 33% |
| 29 | 35% |
| 28 | 36% |
| 27 | 37% |
| 26 | 39% |
| 25 | 40% |
| 24 | 42% |
| 23 | 44% |
| 22 | 45% |
| 21 | 47% |
| 20 | 49% |
| 19 | 51% |
| 18 | 53% |
| 17 | 55% |
| 16 | 57% |
| 15 | 59% |
| 14 | 61% |
| 13 | 63% |
| 12 | 65% |
| 11 | 68% |
| 10 | 70% |

FIG.5

DETERMINATION OF MAXIMUM ALLOWABLE HUMIDITY IN INDOOR SPACE TO AVOID CONDENSATION INSIDE BUILDING ENVELOPE

BACKGROUND OF THE INVENTION

The application claims priority to U.S. Provisional Application No. 60/537,527 which was filed on Jan. 20, 2004, the disclosure of which is incorporated in its entirety herein by reference.

This application relates to an indoor central heating, ventilation, and air conditioning (HVAC) system wherein various units report environmental characteristics to a central control for evaluation in relation to a user input. The central control controls an indoor relative humidity to prevent condensation inside a "building envelope." A building envelope is defined to include all building exterior walls, i.e., walls having a side exposed to the outside elements and the roof.

Relative humidity is defined as the ratio of the actual amount of moisture in the air to the maximum moisture capacity at a given air temperature. It is known that as temperature increases, the capacity of the air to hold moisture in the form of water vapor also increases. Conversely, as temperature decreases, the capacity of the air to hold moisture decreases and any excess moisture condenses as water on surfaces in contact with the air.

Therefore, during the winter months, the cold outdoor air has a relatively low moisture content, however, the air inside building structures is typically heated. Depending on the construction quality of a particular building, some of the cold dry outside air infiltrates into the warm indoor space and is subsequently heated to the indoor temperature. This phenomenon effectively reduces the indoor relative humidity and the indoor air becomes very dry.

To address this winter dryness, humidifiers are often employed as part of the central heating system. Humidifiers introduce moisture into the heated air, increasing indoor relative humidity. Humidifiers are typically controlled by devices known as humidistats. Humidistats sense an actual indoor relative humidity and allow a homeowner to set a desired indoor relative humidity level. When the indoor relative humidity falls below the desired level, the humidistat activates the humidifier to add moisture to the air. Once the desired indoor humidity is achieved, the humidistat deactivates the humidifier.

Buildings typically have thermally insulated walls and attics to minimize heat loss and reduce cold air infiltration. However, portions of the building envelope, such as windows, may be less insulated than others, and their interior surfaces may get colder. If the outdoor temperature is low enough and the indoor humidity high enough, moisture may condense on these less insulated interior surfaces, which is undesirable. Conversely, some buildings in colder climates are built to be extremely "tight" allowing minimal outdoor air infiltration levels. Without the natural drying due to outside air infiltration, internal moisture generated by the occupants and their activities allows the indoor relative humidity to reach high levels resulting in condensation even in the winter months.

To address the concern of high indoor relative humidity, devices known as ventilators are often employed. Once the indoor relative humidity exceeds the desired level, the ventilator is activated to bring a controlled amount of outside dry air into the building envelope to decrease the indoor relative humidity. Ventilators typically are controlled by a second humidistat, separate from and in addition to the humidistat that controls the humidifier.

In general, the colder it is outside, the lower the indoor relative humidity has to be to avoid condensation. Therefore, occupants typically notice condensation when the weather turns cold and respond by lowering the humidistat setting. However, as weather patterns change, frequent manual adjustment is often required. To date there has been no way for the occupant to know exactly how much to adjust the humidity setting. This continual trial and error process results in the indoor relative humidity level either being too high or too low in comparison with the ideal indoor humidity level.

Therefore, controlling indoor relative humidity to a fixed relative humidity level, as with a simple humidistat, is undesirable.

While systems have been proposed to perform detailed calculations of a maximum relative humidity level, the known proposed are quite complex. As such, it is desirable to have an HVAC system that simply, but accurately, determines the maximum allowable indoor relative humidity to prevent condensation inside a building envelope based upon indoor and outdoor temperatures.

SUMMARY OF THE INVENTION

This invention uses known data regarding the psychometric characteristics of air to achieve accurate indoor relative humidity control to prevent condensation without complex mathematical computational requirements.

An HVAC system control employs a simple control algorithm to calculate an effective delta ($\Delta T$) based upon a single adjustment factor and environmental inputs such as indoor temperature, outdoor temperature and/or indoor relative humidity. The effective delta ($\Delta T$) is then used to determine a maximum allowable indoor relative humidity to prevent condensation inside a building envelope.

In one disclosed embodiment of this invention, the user input is a user selectable heating humidity level entered by the building owner/occupant. The occupant selects a heating humidity level from a predetermined range of 1–9 with a default value somewhere in the middle, say 5. The selected heating humidity level is subsequently employed to determine the single adjustment factor (A*). In this embodiment, the central control employs a conversion table stored in memory to convert the user selected heating humidity level to the single adjustment factor (A*). The single adjustment factor (A*) is then employed to calculate the maximum allowable indoor relative humidity based upon the user selected heating humidity level.

The occupant typically sets the heating humidity level to a level just below the one that allows condensation to occur. This is accomplished through an iterative process. The occupant selectively increases the heating humidity level until condensation occurs within the building envelope. The occupant then selectively decreases the heating humidity to the level just below the level at which condensation occurred. Once the occupant has selected the indoor relative humidity level required to prevent condensation, the central control is operable to maintain the actual indoor relative humidity based upon the user selected indoor relative humidity level, continuously adjusting the actual indoor relative humidity to accommodate changing environmental conditions while preventing condensation.

In another disclosed embodiment of this invention, the user input is entered by the HVAC system installer upon installation. The user input is representative of a building structural characteristic and is typically indicative of a thermal insulation level of the building envelope. The user input may be set based on past experience of the installer with respect to previous homes of similar quality. In this embodiment, the central control employs a conversion table to subsequently convert the structural characteristic into the aforementioned single adjustment factor (A*). The single adjustment factor (A*) is then employed to calculate the maximum allowable indoor relative humidity based upon the thermal insulation level of the building. Once set by the installer, the HVAC system is operable to maintain the actual indoor relative humidity level, continually adjusting to accommodate changing environmental conditions to prevent condensation.

These and other features of the present invention can be best understood from the following specification and drawings, the following of which is a brief description.

BRIEF DESCRIPTION OF THE DRAWINGS

FIG. 5 is an example Allowable Humidity Table.

DETAILED DESCRIPTION OF THE PREFERRED EMBODIMENT

Figure 1:
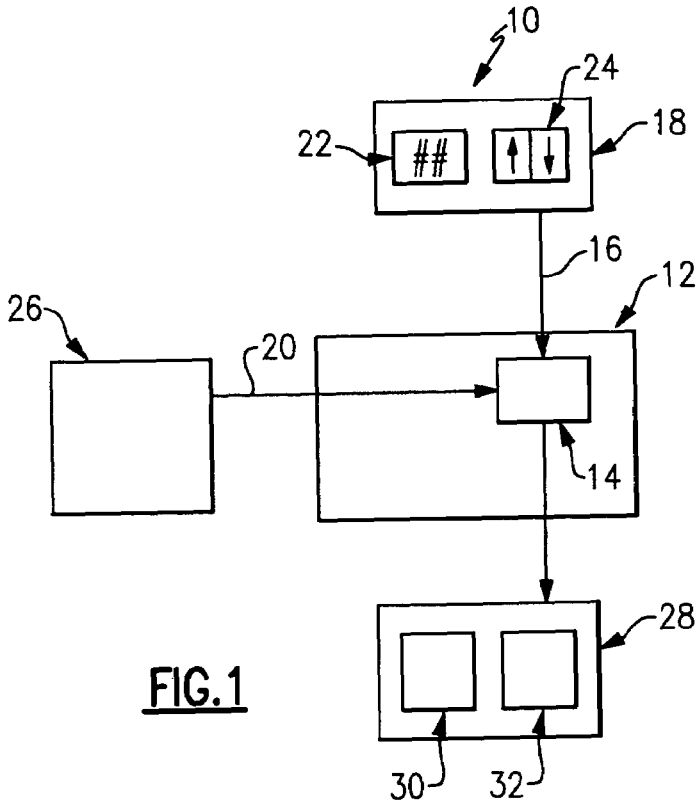
FIG. 1 is a schematic view of a building HVAC system.

A schematic view of a building HVAC system 10 is illustrated in FIG. 1. An indoor control unit 12 includes central control 14 which is operable to receive a user input 16 from a user interface 18 and at least one environmental input 20. The user input 16 is a heating humidity level 22 which is selected from a predetermined range. As shown, the level is adjusted by pressing up/down arrows 24 on the user interface 18. Of course other input devices can be utilized. An outdoor unit 26 is operable to transmit the environmental input 20 to the central control 14.

The central control 14 then calculates a desired indoor relative humidity based upon the user input 16 and the environmental input 20 and adjusts an actual indoor relative humidity to a value proximate the calculated desired indoor relative humidity by selectively activating/deactivating at least one indoor device 28. As is known, the indoor device 28 could be a humidifier 30, and/or a ventilator 32, or other humidity control devices.

Figure 2:
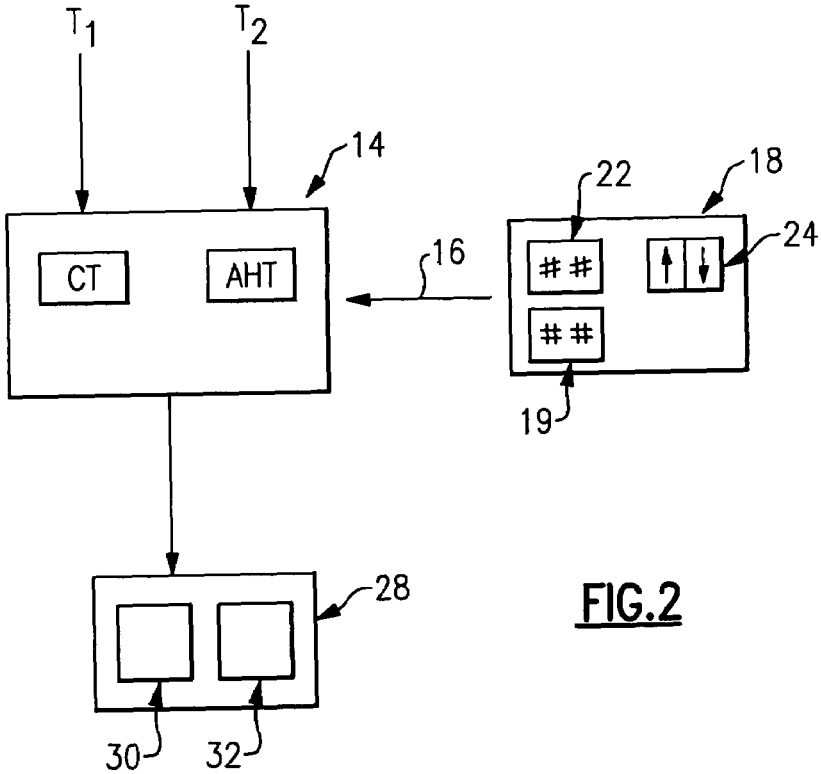
FIG. 2 is a detailed schematic view of a control for an HVAC system.

A detailed schematic view of the central control 14 is illustrated in FIG. 2. Central control 14 is operable to receive a user input 16, and at least one environmental input. A user interface 18 is operable to receive the user input 16 to set a desired temperature 19 and humidity level 22, and transmit the user input 16 to the central control 14. The environmental input includes an outdoor temperature $T_1$, and an indoor temperature $T_2$. The central control 14 also includes at least one reference table stored in a memory.

Known tables have been published that relate an air temperature, t, to a humidity ratio at saturation, $W_s$. The humidity ratio at saturation, $W_s$, represents the maximum moisture holding capacity of the air at the temperature, t. One example table titled: Thermodynamic Properties of Moist Air, Standard Atmospheric Pressure, 14,696 p.s.i. (29.921 in. Hg.) can be found in the A.S.H.R.A.E. Fundamentals Handbook, published in 1997 (A.S.H.R.A.E. Table).

In order to provide a simple, but accurate, method to calculate either t from $W_S$ or $W_S$ from t, the following observation has been made. The ratio of $W_s$ at two different temperatures, $t_1$ and $t_2$, is largely dependent on the difference between $t_1$ and $t_2$, and not on the individual temperatures themselves. This ratio can be conveniently expressed as an allowable humidity percentage (% RH). For example, assume $t_2$ is greater than $t_1$ and the corresponding values of $W_S$ are $W_{S1}$ and $W_{S2}$. As graphically illustrated in FIG. 3, the ratio of $W_{S1}$ and $W_{S2}$ (% RH) can be closely approximated, based upon the A.S.H.R.A.E. table, as a function of the difference between $t_1$ and $t_2$ (Delta T). Further, FIG. 3 also shows that for any value of Delta T, the ratio of $W_{S1}$ and $W_{S2}$ is virtually the same whether $t_2$ is 60 degrees F. or 73 degrees F.

Typically, $t_2$ represents an indoor temperature and $t_1$ represents an outdoor temperature. Therefore, for example, in a heating season, i.e. when the outdoor temperature is lower than the indoor temperature, $t_2$ is typically controlled between 60 degrees F. and 72 degrees F. while $t_1$ can typically vary from −15 degrees F. to 55 degrees F.

In one theoretical situation, where a building envelope has no thermal insulation, the temperature of the building indoor surfaces will be equal to the outdoor temperature, $t_1$. In this theoretical situation, condensation will occur on the building interior surfaces if an indoor moisture content (humidity ratio) exceeds $W_{S1}$, which is the saturation level for $t_1$. Thus, to avoid condensation on the building indoor surfaces, the maximum allowable indoor moisture content is $W_{S1}$. In addition, it should be understood that at the indoor temperature t2, the moisture holding capacity of the indoor air is $W_{S2}$. Per the definition of relative humidity, the ratio of $W_{S1}$ and $W_{S2}$ is the indoor relative humidity at which condensation occurs. Therefore, the ratio of $W_{S1}$ and $W_{S2}$ is the allowable indoor relative humidity to avoid condensation.

However, because all building envelopes have at least some level of thermal insulation, the above is simply a limiting case. In actual building envelopes, an effective Delta T is less than the actual difference between indoor temperature and outdoor temperature because the building envelope acts as an insulating barrier that reduces the effect of outdoor temperature on an indoor space. The effective Delta T (ΔT) is calculated based upon an equation:

$$\Delta T = A^*(t_2 - t_1)$$

where A* is an adjustment factor and a lower adjustment factor indicates a better insulated home.

In one embodiment, the user input 16 is a user selectable heating humidity level which is selected from a predetermined range and adjusted by pressing up/down arrows 24 on the user interface 18. In this embodiment, the heating humidity level is typically initially entered by the homeowner and adjusted to the level just below the one that allows condensation to occur. This is accomplished through an iterative process. The occupant selectively increases the heating humidity level until condensation occurs within the building envelope. The occupant then selectively decreases the heating humidity to the level just below the level at which condensation occurred. Once set, the homeowner is not required to make any further adjustments, as the central control 14 is operable to compensate for indoor and outdoor temperature variations, controlling a maximum allowable indoor humidity to prevent condensation. Of course, the iterative process could be performed by the system installer, rather than the occupant. In this embodiment, the central control 14 employs a Conversion Table (CT), illustrated in FIG. 3, to convert the user input 16 into an adjustment factor A*. After conversion, the central control 14 then calculates an effective delta ΔT based upon the formula:

$$\Delta T = A^*(t_2 - t_1)$$

Figures 3, 4:
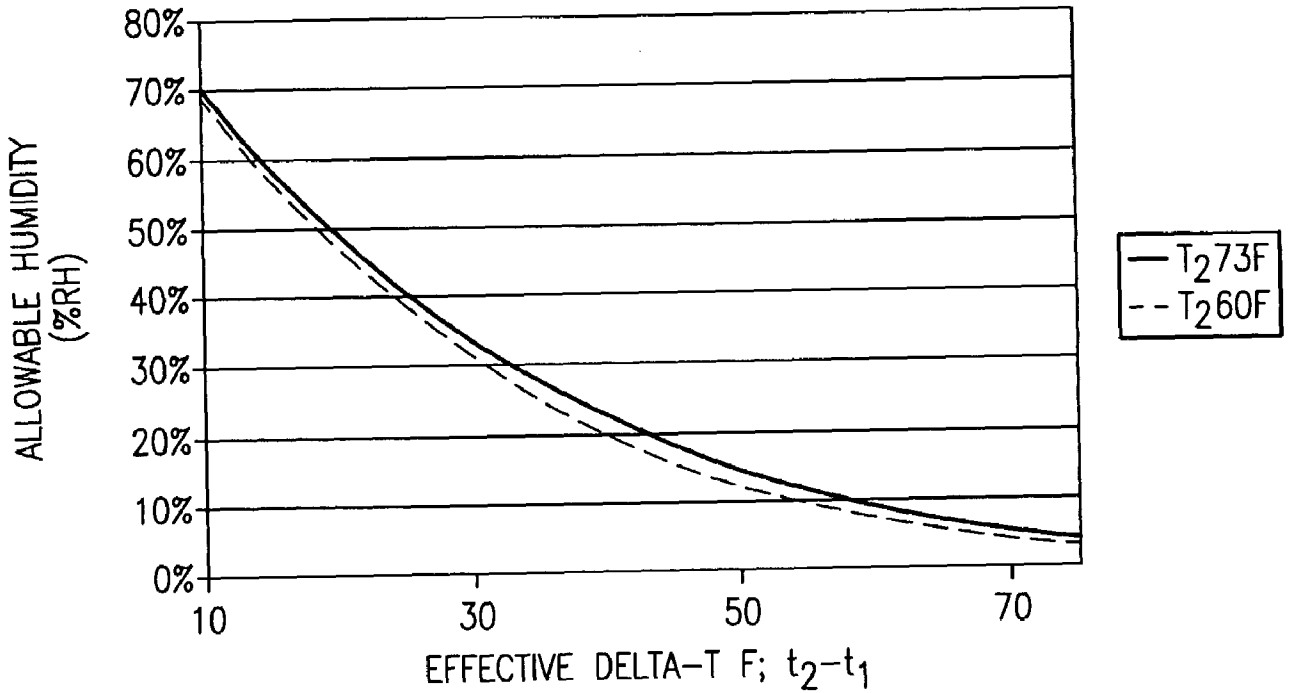
FIG. 3 is a graphical representation of a relationship between an allowable relative humidity percentage and a difference between two different temperatures.
FIG. 4 is an example Conversion Table.

After calculating the effective delta ΔT, the central control 14 employs an Allowable Humidity Table (AHT), illustrated in FIG. 4, to determine a maximum allowable indoor relative humidity. Of course, other ways of determining a reference value to compare to such a table come within the scope of this invention. Any method of utilizing a user input and an environmental input to determine a value reference to be compared to a table comes within the scope of this invention.

After determining the maximum allowable indoor relative humidity, the central control 14 is operable to selectively activate/deactivate indoor device 28 to adjust an actual indoor relative humidity to a value less than the calculated maximum allowable indoor relative humidity to prevent condensation. Whether to activate or deactivate the indoor device 28 is determined by comparing the actual indoor relative humidity to the calculated maximum allowable indoor relative humidity.

If the indoor device 28 is a humidifier 30 and, upon comparison, the central control 14 determines that the actual indoor relative humidity is less than the calculated maximum allowable indoor relative humidity, the central control 14 activates the humidifier 30. By activating the humidifier 30, warm wet air is generated and introduced into the building envelope, effectively increasing the actual indoor relative humidity. Conversely, if upon comparison, the central control 14 determines that the actual indoor relative humidity is greater than the calculated maximum allowable indoor relative humidity, the central control 14 deactivates the humidifier 30 allowing the actual indoor relative humidity to decrease.

Further, if the indoor device 28 is a ventilator 32 and, upon comparison, the central control 14 determines that the actual indoor relative humidity is greater than the calculated maximum allowable indoor relative humidity, the central control 14 activates the ventilator 32. By activating the ventilator 32, cool dry outside air is brought into the building envelope, effectively decreasing the actual indoor relative humidity. Conversely if, upon comparison, the central control unit 14 determines that the actual indoor relative humidity is less than the calculated maximum allowable indoor relative humidity, the central control 14 deactivates the ventilator 32 allowing the actual indoor relative humidity to increase.

Finally, if the indoor device 28 includes both a humidifier 30 and a ventilator 32, the central control 14 is operable to determine the actual indoor relative humidity and compare the actual indoor relative humidity to the calculated maximum allowable indoor relative humidity. Based upon this comparison, the central control 14 is then operable to selectively activate/deactivate either one or both of the humidifier 30 and/or the ventilator 32 to regulate the actual indoor relative humidity to a value less than the maximum allowable indoor relative humidity, preventing condensation.

In another embodiment, the user input 16 is entered by the HVAC system installer. In this embodiment, the user input 16 is representative of a building structural characteristic typically indicative of the thermal insulation level of the building envelope. In this embodiment, the building structural characteristic corresponds to a heating humidity level and is typically entered by the installer of the HVAC based upon his knowledge of the thermal insulation level of the building and his past experience with buildings of similar quality. Once set by the HVAC system installer, the building owner is typically not required to make further adjustments, as the central control 14 is operable to compensate for indoor and outdoor temperature variations, controlling the maximum allowable indoor humidity based upon the thermal insulation level of the building envelope to prevent condensation.

By associating a determined reference value with stored maximum allowable indoor relative humidity values, the present invention is able to provide accurate humidity control in a relatively simple system.

Although two preferred embodiments of this invention have been disclosed, a worker of ordinary skill in this art would recognize that certain modifications would come within the scope of this invention. For that reason, the following claims should be studied to determine the true scope and content of this invention.

What is claimed is:

1. A control for an HVAC system comprising:

a control unit receiving at least one environmental input from a sensor, wherein said at least one environmental input includes an outdoor temperature and an indoor temperature and said control unit includes a memory; and an interface for entering a user input into said control unit, wherein said control unit determines a reference value based upon said user input, said outdoor temperature and said indoor temperature, said control unit compares said reference value to values stored in an allowable humidity table located in said memory to determine a maximum allowable indoor relative humidity, and said control unit adjusts an actual indoor relative humidity based upon said maximum allowable indoor relative humidity.

2. The control as recited in claim 1, wherein said reference value is an effective delta calculated based upon said indoor temperature, said outdoor temperature and said user input.

3. The control as recited in claim 2, wherein said memory further includes a conversion table for converting said user input into an adjustment factor, wherein said adjustment factor is utilized to calculate said effective delta.

4. The control as recited in claim 3, wherein said user input is a user selectable humidity level.

5. The control as recited in claim 3, wherein said user input is representative of a building structure characteristic.

6. The control as recited in claim 1, wherein said actual indoor relative humidity is adjusted to a level below said maximum allowable indoor relative humidity.

7. The control as recited in claim 1, wherein said control unit is operable to selectively activate or de-activate at least one device to adjust said actual indoor relative humidity to a level below said maximum allowable indoor relative humidity.

8. The control as recited in claim 1, wherein said at least one environmental input includes an actual indoor relative humidity sensor operable to communicate said actual indoor relative humidity to said central control unit.

9. The control as recited in claim 8, wherein said central control unit is operable to selectively activate or de-activate at least one device when said actual indoor relative humidity reaches a predetermined value.

10. A method of controlling relative humidity comprising:

measuring an indoor temperature;

measuring an outdoor temperature;

inputting a user input; and calculating a reference value delta based upon said measured indoor temperature, said measured outdoor temperature and said user input;

determining a maximum allowable indoor relative humidity based upon said calculation; and adjusting an indoor relative humidity based upon said determined maximum allowable indoor relative humidity.

11. The method as recited in claim 10, further including a converting step wherein said user input is converted to an adjustment factor via a conversion table prior to said calculating step; said adjustment factor being used to calculate said reference value.

12. The method as recited in claim 11, wherein said user input is a user selectable heating humidity level.

13. The method as recited in claim 11, wherein said user input is representative of a characteristic of a building structure.

14. The method as recited in claim 10, wherein said indoor relative humidity is adjusted to be less than said maximum allowable indoor relative humidity.

15. A HVAC system comprising:

a control unit operable to receive a user input from a user interface and an at least one environmental input;

an outdoor unit operable to transmit an outdoor environmental input from an outdoor sensor to said control unit, wherein said outdoor environmental input is an outdoor temperature;

an indoor unit operable to transmit an indoor environmental input from an indoor sensor to said control unit, wherein said indoor environmental input is an indoor temperature; and an at least one indoor device operable to adjust an actual indoor relative humidity; wherein said control unit determines a reference value based upon said outdoor temperature, said indoor temperature and said user input, determines a maximum allowable indoor relative humidity based upon said reference value, and selectively activates or de-activates said at least one indoor device to adjust said actual indoor relative humidity to a value based upon said maximum allowable indoor relative humidity to prevent condensation.

16. The HVAC system as recited in claim 15, wherein said user input is representative of a characteristic of a building structure.

17. The HVAC system as recited in claim 15, wherein said user input is a user selectable heating humidity level.

18. The HVAC system as recited in claim 15, wherein said control unit further includes a memory, said memory including a conversion table for converting said user input into an adjustment factor, and an allowable humidity table for determining said maximum allowable indoor relative humidity based upon said reference value.

19. The HVAC system as recited in claim 15, wherein said control unit is operable to selectively activate or de-activate said at least one device to adjust said actual indoor relative humidity to a value less than said maximum allowable indoor relative humidity.

20. The HVAC system as recited in claim 15, wherein said reference value is calculated as an effective delta based at least in part on a difference between said outdoor environmental input and said indoor environmental input.

* * * * *